US009657738B2

(12) United States Patent
Bonnefoi et al.

(10) Patent No.: US 9,657,738 B2
(45) Date of Patent: May 23, 2017

(54) SCROLL COMPRESSOR

(71) Applicant: Danfoss Commercial Compressors, Trevoux (FR)

(72) Inventors: Patrice Bonnefoi, Saint Didier au Mont d'or (FR); Yves Rosson, Villars les Dombes (FR); Ingrid Claudin, Villars-les-Dombes (FR)

(73) Assignee: Danfoss Commercial Compressors, Trevoux (FR)

( * ) Notice: Subject to any disclaimer, the term of this patent is extended or adjusted under 35 U.S.C. 154(b) by 10 days.

(21) Appl. No.: 14/890,216

(22) PCT Filed: May 21, 2014

(86) PCT No.: PCT/EP2014/060465
§ 371 (c)(1),
(2) Date: Nov. 10, 2015

(87) PCT Pub. No.: WO2014/191282
PCT Pub. Date: Dec. 4, 2014

(65) Prior Publication Data

US 2016/0108917 A1 Apr. 21, 2016

(30) Foreign Application Priority Data

May 31, 2013 (FR) ..... 13 54976

(51) Int. Cl.
*F04C 18/00* (2006.01)
*F04C 18/02* (2006.01)
(Continued)

(52) U.S. Cl.
CPC ..... *F04C 29/005* (2013.01); *F04C 18/0215* (2013.01); *F04C 18/0223* (2013.01);
(Continued)

(58) Field of Classification Search
CPC .... F04C 29/005; F04C 29/023; F04C 23/008; F04C 18/0223; F04C 18/0215; F04C 2240/60
(Continued)

(56) References Cited

U.S. PATENT DOCUMENTS 5,775,893 A 7/1998 Takao et al.
2015/0361983 A1* 12/2015 Ignatiev ..... F04C 29/0071 418/55.5

FOREIGN PATENT DOCUMENTS

CN 1840916 A 10/2006
CN 101287910 A 10/2008
(Continued)

OTHER PUBLICATIONS

International Search Report for PCT Serial No. PCT/EP2014/060465 dated Jul. 8, 2014.

*Primary Examiner* — Nicholas J Weiss
*Assistant Examiner* — Dapinder Singh
(74) *Attorney, Agent, or Firm* — McCormick, Paulding & Huber LLP

(57) ABSTRACT

This scroll compressor (2) includes a first fixed scroll (4), an orbiting scroll arrangement (7), a drive shaft (18) adapted for driving the orbiting scroll arrangement (7) in an orbital movement, a driving unit coupled to the drive shaft (18) and arranged for driving in rotation the drive shaft (18) about a rotation axis, and guide elements for guiding in rotation the drive shaft (18), the guide elements comprising at least a first guide bearing (29) and a second guide bearing (30) arranged to respectively guide a first portion (26) and a second portion (27) of the drive shaft (18). The drive shaft (18) extends across the orbiting scroll arrangement (7) such that the first and second portions (26, 27) of the drive shaft (18) are located on either side of the orbiting scroll arrangement (7),
(Continued)

the first and second guide bearings (29, 30) being located on either side of the orbiting scroll arrangement (7).

20 Claims, 2 Drawing Sheets

(51) Int. Cl.
*F04C 29/00* (2006.01)
*F04C 29/02* (2006.01)
*F04C 23/00* (2006.01)

(52) U.S. Cl.
CPC ..... *F04C 23/008* (2013.01); *F04C 29/023* (2013.01); *F04C 2240/60* (2013.01)

(58) Field of Classification Search
USPC ..... 418/55.1–55.6
See application file for complete search history.

(56) References Cited

FOREIGN PATENT DOCUMENTS

| | | | |
|---|---|---|---|
| CN | 102257276 | A | 11/2011 |
| EP | 1 818 540 | A1 | 8/2007 |
| JP | H08-170592 | A | 7/1996 |
| JP | 2007-146705 | A | 6/2007 |
| WO | 2012/029203 | A1 | 3/2012 |

* cited by examiner

SCROLL COMPRESSOR

CROSS-REFERENCE TO RELATED APPLICATIONS

This application is entitled to the benefit of and incorporates by reference subject matter disclosed in the International Patent Application No. PCT/EP2014/060465 filed on May 21, 2014 and French Patent Application No. 13/54976 filed on May 31, 2013.

TECHNICAL FIELD

The present invention relates to a scroll compressor, and in particular to a scroll refrigeration compressor.

BACKGROUND

As known, a scroll compressor comprises:

a closed housing, a scroll compression unit adapted for compressing refrigerant and including an orbiting scroll and a fixed scroll, a drive shaft adapted for driving the orbiting scroll in an orbital movement, a driving unit coupled to the drive shaft and arranged for driving in rotation the drive shaft about a rotation axis, and guide elements for guiding in rotation the drive shaft, the guide elements comprising at least a lower guide bearing provided on a centering part attached to the closed housing, an intermediate bearing provided on a support frame on which is slidably supported the orbiting scroll, and an upper guide bearing provided on a connecting sleeve projecting from the lower side of the orbiting scroll, the lower, intermediate and upper guide bearings being arranged to respectively guide lower, intermediate and upper portions of the drive shaft.

Such a configuration of the drive shaft and the guide elements induces a large deflection of the drive shaft notably in the upper portion of the latter due to the mechanical loads supported by the drive shaft coming from the compressed refrigerant and the inertia forces induced by the orbiting movement of the orbiting scroll.

Due to said deflection, the drive shaft cannot be operated at high rotational speed, that is at a rotational speed higher than 9000 rpm. Thus the operating speed range of the scroll compressors of the prior art is limited.

SUMMARY

It is an object of the present invention to provide an improved refrigeration compressor which can overcome the drawbacks encountered in conventional scroll compressors.

Another object of the present invention is to provide a scroll compressor which can be operated safely at high rotational speeds.

According to the invention such a scroll compressor includes:

a first fixed scroll comprising a first fixed spiral wrap, an orbiting scroll arrangement including at least a first orbiting spiral wrap, the first fixed spiral wrap and the first orbiting spiral wrap forming a plurality of first compression chambers, a drive shaft extending across the orbiting scroll arrangement, the drive shaft including a first portion and a second portion located on either side of the orbiting scroll arrangement, and a driving portion located between the first and second portions and adapted for driving the orbiting scroll arrangement in an orbital movement, a driving unit coupled to the drive shaft and arranged for driving in rotation the drive shaft about a rotation axis, and guide elements for guiding in rotation the drive shaft, the guide elements comprising at least a first guide bearing and a second guide bearing located on either side of the orbiting scroll arrangement and arranged to respectively guide the first and second portions of the drive shaft, wherein the drive shaft comprises a first end portion and a second end portion opposite to the first end portion, the first end portion including a central recess and having an external diameter larger than an external diameter of the second end portion.

In other words, the orbiting scroll arrangement comprises a first side facing toward the first portion of the drive shaft and the first guide bearing, and a second side opposite to the first side and facing toward the second portion of the drive shaft and the second guide bearing.

Such a location of the first and second guide bearings reduces the drive shaft deflection, notably close to the orbiting scroll arrangement, and therefore limits the flank clearance and improves the performances of the scroll compressor.

Further the reduction of the drive shaft deflection at the guide bearings locations improves the guide bearings reliability. Moreover, the reduction of the drive shaft deflection at the rotor location avoids on one hand the rotor-stator contacts in the motor of the driving unit and thus improves the driving unit reliability, and reduces on the other hand the mechanical loads applied on the guide bearings and thus further improves the guide bearings reliability. Furthermore the reduction of the drive shaft deflection at the rotor location allows reducing the motor air gap and so improves the driving unit performances.

All these improvements allow to operate the scroll compressor safely in the whole operating speed range and notably at high rotational speeds (that is at a rotation speed substantially higher than 9000 rpm), and improve compressor reliability and performance.

Moreover the arrangement of the first end portion of the drive shaft improves the rigidity of the drive shaft without increasing the deflection of the drive shaft. As the drive shaft is more rigid, its first eigen frequency is shifted to an higher level.

According to an embodiment of the invention, the first and second guide bearings are substantially equally spaced from the orbiting scroll arrangement. Such a configuration allows to symmetrically support the mechanical loads applied to the drive shaft.

According to an embodiment of the invention, the first guide bearing is provided on the first fixed scroll According to an embodiment of the invention, the scroll compressor further includes a first counterweight and a second counterweight connected to the drive shaft, the first and second counterweights being located respectively on either side of the orbiting scroll arrangement. In other words, the first and second sides of the orbiting scroll arrangement face toward respectively the first and second counterweights. This arrangement of the first and second counterweights allows to balance the mass of the orbiting scroll arrangement with a limited tilting of the drive shaft. Such a limited tilting of the drive shaft, as the reduction of the deflection of the drive shaft, improves the guide bearings reliability and the driving unit reliability, and therefore the compressor reliability and performance.

According to an embodiment of the invention, the first and second counterweights are substantially equally spaced from the orbiting scroll arrangement.

According to an embodiment of the invention, the first and second counterweights are arranged and located such that there is no global tilting of the drive shaft.

According to an embodiment of the invention, the first counterweight and the drive shaft are formed as a one-piece element.

According to an embodiment of the invention, the first counterweight is formed by removing material from the drive shaft.

According to another embodiment of the invention, the second counterweight is distinct from the drive shaft and is attached to the drive shaft.

According to an embodiment of the invention, the scroll compressor is a vertical scroll compressor and the drive shaft extends substantially vertically.

According to an embodiment of the invention, the first portion of the drive shaft and the first guide bearing are located above the orbiting scroll arrangement, and the second portion of the drive shaft and the second guide bearing are located below the orbiting scroll arrangement.

According to an embodiment of the invention, the first and second counterweights are respectively located above and below the orbiting scroll arrangement.

According to an embodiment of the invention, the drive shaft is a stepped drive shaft. This arrangement ensures an easy assembly of the scroll compressor. According to an embodiment of the invention, the stepped drive shaft includes at least four different diameters, in order to facilitate compressor assembly and to limit the shaft deflection/to sustain deformation at high speeds.

According to an embodiment of the invention, the central recess emerges in an end face of the drive shaft opposite to the second end portion.

According to an embodiment of the invention, the external diameter of the first end portion corresponds to the largest external diameter of the drive shaft, and the external diameter of the second end portion corresponds to the smallest external diameter of the drive shaft.

According to an embodiment of the invention, the external diameter of the drive shaft decreases from the first end portion towards the second end portion.

According to an embodiment of the invention, the driving unit comprises a motor having a stator and a rotor, the drive shaft comprising a rotor support portion on which is fitted the rotor.

According to an embodiment of the invention, the guide elements are located on a same side of the drive shaft in relation to the rotor support portion. This arrangement facilitates again the assembly of the scroll compressor.

According to an embodiment of the invention, the scroll compressor includes an oil sump and the orbiting scroll arrangement comprises a first side facing toward the oil sump and a second side opposite to the first side and facing toward the rotor support portion.

According to an embodiment of the invention, the driving unit is located above the orbiting scroll arrangement. According to said embodiment of the invention, the rotor support portion is located above the orbiting scroll arrangement.

According to an embodiment of the invention, the first end portion of the drive shaft forms the rotor support portion.

According to an embodiment of the invention, the driving portion of the drive shaft is off-centered from the center axis of the drive shaft.

According to an embodiment of the invention, the guide elements further comprise a third guide bearing provided on the orbiting scroll arrangement and arranged for guiding the driving portion.

According to an embodiment of the invention, the scroll compressor further includes a second fixed scroll comprising a second fixed spiral wrap, and the orbiting scroll arrangement further includes a second orbiting spiral wrap, the second fixed spiral wrap and the second orbiting spiral wrap forming a plurality of second compression chambers.

According to an embodiment of the invention, the first and second orbiting spiral wraps are respectively provided on first and second faces of a common end plate, the second face being opposite to the first face.

According to an embodiment of the invention, the second guide bearing is provided on the second fixed scroll.

According to another embodiment of the invention, the scroll compressor further includes a support frame on which is slidably supported the orbiting scroll arrangement. According to an embodiment of the invention, the first guide bearing is provided on the support frame.

According to an embodiment of the invention, the drive shaft comprises at least one lubrication channel connected to an oil sump of the scroll compressor and extending over at least a part of the length of the drive shaft.

According to an embodiment of the invention, the drive shaft further comprises at least a first lubrication hole and a second lubrication hole each fluidly connected to a respective lubrication channel, the first and second lubrication holes opening respectively into an outer wall of the first and second portions of the drive shaft.

According to an embodiment of the invention, the drive shaft comprises a third lubrication hole fluidly connected to a respective lubrication channel, the third lubrication hole opening into an outer wall of the driving portion of the drive shaft.

According to an embodiment of the invention, at least one lubrication channel is substantially parallel to the center axis of the drive shaft and off-centered from the center axis of the drive shaft.

According to an embodiment of the invention, the drive shaft further comprises at least one vent hole fluidly connected to a respective lubrication channel. According to an embodiment of the invention, at least one vent hole may for example extend substantially radially relative to the drive shaft.

According to an embodiment of the invention, at least one vent hole is fluidly connected to the central recess of the first end portion of the drive shaft.

According to an embodiment of the invention, the drive shaft comprises at least a first lubrication channel and a second lubrication channel.

According to an embodiment of the invention, the drive shaft further comprises a communicating channel arranged to fluidly connect the first and second lubrication channels. The communicating channel ensures the degassing of the oil circulating in the second lubrication duct, and the flow of the refrigerant originating from the degassing into the first lubrication duct.

According to an embodiment of the invention, at least one lubrication channel is fluidly connected to the central recess. Advantageously, the first lubrication channel is fluidly connected to the central recess.

According to an embodiment of the invention, the first lubrication channel is fluidly connected to the first lubrication hole and the second lubrication channel is fluidly connected to the second lubrication hole.

According to an embodiment of the invention, the first lubrication channel is stepped and comprises a first channel portion fluidly connected to the oil sump and a second channel portion having an inner diameter larger than an inner diameter of the first channel portion. Advantageously, the first lubrication hole opens into the second channel portion of the first lubrication channel.

According to an embodiment of the invention, the third lubrication hole opens into the second channel portion of the first lubrication channel.

According to an embodiment of the invention, each lubrication hole extends substantially radially relative to the drive shaft.

According to an embodiment of the invention, the lubrication channel is arranged to be supplied with oil from the oil sump by an oil pump driven by the drive shaft.

According to an embodiment of the invention, the lubrication channel emerges in an end face of the drive shaft opposite to the first end portion.

According to an embodiment of the invention, the scroll compressor is a variable-speed scroll compressor.

According to another embodiment of the invention, the scroll compressor is a fixed-speed scroll compressor.

According to an embodiment of the invention, the first portion, the second portion, the driving portion and the rotor support portion of the drive shaft have different external diameters.

According to an embodiment of the invention, the scroll compressor comprises at least a first Oldham coupling provided between the orbiting scroll arrangement and the first fixed scroll, and configured to prevent rotation of the orbiting scroll arrangement with respect to the first fixed scroll. According to such an embodiment of the invention, the first and second counterweight are arranged to balance the mass of the orbiting scroll arrangement and of the first Oldham coupling.

According to an embodiment of the invention, the scroll compressor further comprises a second Oldham coupling provided between the orbiting scroll arrangement and the second fixed scroll, and configured to prevent rotation of the orbiting scroll arrangement with respect to the second fixed scroll. According to such an embodiment of the invention, the first and second counterweight are arranged to balance the mass of the orbiting scroll arrangement and of the first and second Oldham couplings.

The present invention also concerns a drive shaft for a scroll compressor, including:

- a first portion and a second portion adapted to be guided respectively by a first guide bearing and a second guide bearing of the scroll compressor,
- a driving portion adapted for driving an orbiting scroll arrangement of the scroll compressor in an orbital movement, the driving portion being located between the first and second portions of the drive shaft, wherein the drive shaft comprises a first end portion and a second end portion opposite to the first end portion, the first end portion including a central recess and having an external diameter larger than an external diameter of the second end portion.

These and other advantages will become apparent upon reading the following description in view of the drawing attached hereto representing, as a non-limiting example, an embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
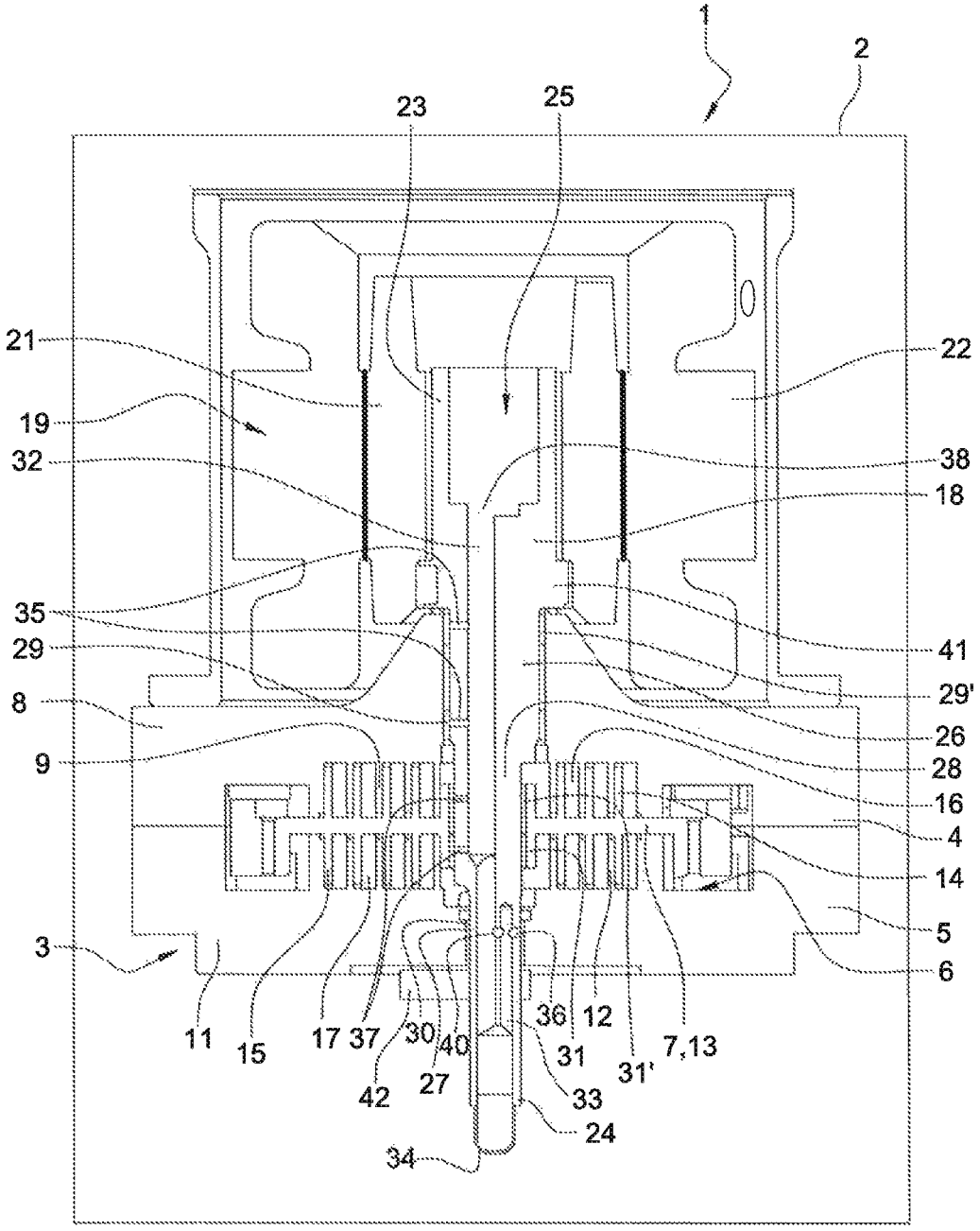
FIG. 1 is a longitudinal section view of a scroll compressor according to the invention.
Figure 2:
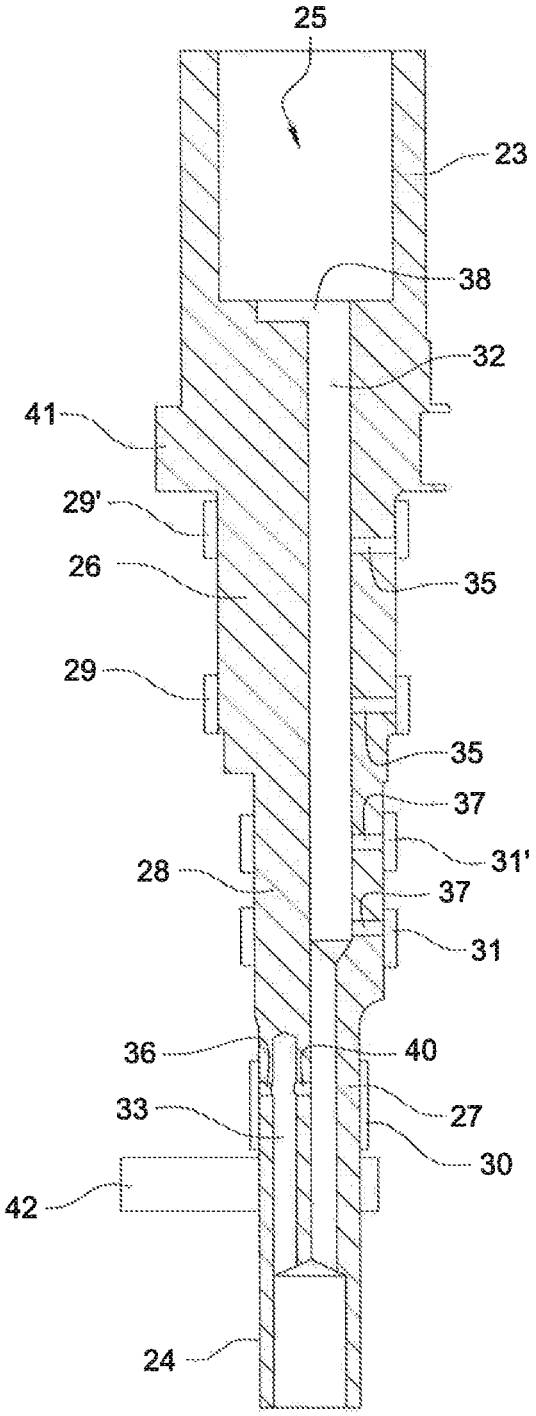
FIG. 2 is a longitudinal section view of the drive shaft of the scroll compressor of FIG. 1.

FIG. 1 shows a vertical scroll compressor 1 including a closed housing 2 and a scroll compression unit 3 disposed inside the closed housing 2.

The scroll compression unit 3 includes first and second fixed scrolls 4, 5 delimiting an inner volume 6. In particular the first and second fixed scrolls 4, 5 are fixed in relation to the closed housing 2. The first fixed scroll 4 may for example be secured to the second fixed scroll 5. The scroll compression unit 3 further includes an orbiting scroll arrangement 7 disposed in the inner volume 6.

The first fixed scroll 4 includes an end plate 8 and a spiral wrap 9 projecting from the end plate 8 towards the second fixed scroll 5, and the second fixed scroll 5 includes an end plate 11 and a spiral wrap 12 projecting from the end plate 11 towards the first fixed scroll 4.

The orbiting scroll arrangement 7 includes an end plate 13, a first spiral wrap 14 projecting from a first face of the end plate 13 towards the first fixed scroll 4, and a second spiral wrap 15 projecting from a second face of the end plate 13 towards the second fixed scroll 5, the second face being opposite to the first face such that the first and second spiral wraps 14, 15 project in opposite directions. The first and second fixed scrolls 4, 5 are respectively located above and below the orbiting scroll arrangement 7.

The first spiral wrap 14 of the orbiting scroll arrangement 7 meshes with the spiral wrap 9 of the first fixed scroll 4 to form a plurality of compression chambers 16 between them, and the second spiral wrap 15 of the orbiting scroll arrangement 7 meshes with the spiral wrap 12 of the second fixed scroll 5 to form a plurality of compression chambers 17 between them. Each of the compression chambers 16, 17 has a variable volume which decreases from the outside towards the inside, when the orbiting scroll arrangement 7 is driven to orbit relative to the first and second fixed scrolls 4, 5.

Furthermore the scroll compressor 1 comprises a stepped drive shaft 18 adapted for driving the orbiting scroll arrangement 7 in orbital movements, and a driving unit 19 coupled to the drive shaft 18 and arranged for driving in rotation the drive shaft 18 about a rotation axis. The driving unit 19 comprises an electric motor located above the first fixed scroll 4. The electric motor has a rotor 21 fitted on the drive shaft 18, and a stator 22 disposed around the rotor 21. For example, the electric motor may be a variable-speed electric motor.

The drive shaft 18 extends vertically across the end plate 13 of the orbiting scroll arrangement 7. The drive shaft 18 comprises a first end portion 23 located above the first fixed scroll 4 and on which is fitted the rotor 21, and a second end portion 24 opposite to the first end portion 23 and located below the second fixed scroll 5. The first end portion 23 has an external diameter larger than the external diameter of the second end portion 24. The first end portion 23 includes a central recess 25 emerging in the end face of the drive shaft 18 opposite to the second end portion 24.

The drive shaft 18 further comprises a first intermediate portion 26 and a second intermediate portion 27 located between the first and second end portion 23, 24, and an eccentric driving portion 28 located between the first and second intermediate portions 26, 27 and being off-centered from the center axis of the drive shaft 18. The eccentric driving portion 28 is arranged to cooperate with the orbiting scroll arrangement 7 so as to cause the latter to be driven in an orbital movement relative to the first and second fixed scroll 4, 5 when the electric motor is operated.

The scroll compressor 1 further comprises guide elements for guiding in rotation the drive shaft 18. The guide elements comprise at least a first guide bearing 29 provided on the first fixed scroll 4 and arranged for guiding the first intermediate portion 26 of the drive shaft 18, a second guide bearing 30 provided on the second fixed scroll 5 and arranged for guiding the second intermediate portion 27 of the drive shaft 18, and a third guide bearing 31 provided on the orbiting scroll arrangement 7 and arranged for guiding the eccentric driving portion 28 of the drive shaft 18. According to the embodiment shown on the figures, the guide elements further comprise a fourth guide bearing 29' provided on the first fixed scroll 4 and arranged for guiding the first intermediate portion 26 of the drive shaft 18, and a fifth guide bearing 31' provided on the orbiting scroll arrangement 7 and arranged for guiding the eccentric driving portion 28 of the drive shaft 18.

It should be noted that the guide bearings 29, 29', 30, 31, 31' are located on a same side of the drive shaft 18 in relation to the first end portion 23, and that the first and second guide bearings 29, 30 are substantially equally spaced from the orbiting scroll arrangement 7.

The drive shaft 18 further comprises a first and a second lubrication channels 32, 33 extending over a part of the length of the drive shaft 18 and arranged to be supplied with oil from an oil sump defined by the closed housing 2, by an oil pump 34 driven by the second end portion 24 of the drive shaft 18.

According to the embodiment shown on the figures, the first and second lubrication channels 32, 33 are substantially parallel to the center axis of the drive shaft 18 and off-centered from the center axis of the drive shaft 18. However, according to another embodiment of the invention, the first and second lubrication channels 32, 33 may be inclined relative to the center axis of the drive shaft 18.

According to the embodiment shown on the figures, the oil pump 34 is made of a pump element having a substantially cylindrical connecting portion connected to the second end portion 24 of the drive shaft 18 and an end portion having a curved shape and provided with an oil opening. However, according to another embodiment of the invention, the oil pump 34 may be made of the second end portion 24 of the drive shaft 18.

The drive shaft 18 also comprises at least one first lubrication hole 35 fluidly connected to the first lubrication channel 32 and opening into an outer wall of the first intermediate portion 26 of the drive shaft 18, at least one second lubrication hole 36 fluidly connected to the second lubrication channel 33 and opening into an outer wall of the second intermediate portion 27 of the drive shaft 18, and at least one third lubrication hole 37 fluidly connected to the first lubrication channel 32 and opening into an outer wall of the eccentric driving portion 28 of the drive shaft 18. Advantageously, each of the first, second and third lubrication holes extends substantially radially relative to the drive shaft 18.

According to the embodiment shown on the figures, the drive shaft 18 comprises two first lubrication holes 35, one second lubrication hole 36 and two third lubrication holes 37, the first lubrication holes 35 respectively facing the guide bearings 29, 29', and the third lubrication holes 37 respectively facing the guide bearings 31, 31'. According to an embodiment not shown on the figures, the drive shaft 18 may comprise only one third lubrication hole 37 located between the guide bearings 31, 31'

The drive shaft 18 may further comprise a vent hole 38 fluidly connected on the one hand to the first lubrication channel 32 and on the other hand to the central recess 25 of the first end portion 23 of the drive shaft 18. The vent hole 38 may for example extend substantially radially relative to the drive shaft 18.

The drive shaft 18 may further comprise a communicating channel 40 arranged to fluidly connect the first and second lubrication channels 32, 33. The communicating channel 40 ensures the degassing of the oil circulating in the second lubrication duct 33, and the flow of the refrigerant originating from the degassing into the first lubrication duct 32 towards the vent hole 38.

The scroll compressor 1 further includes a first counterweight 41 and a second counterweight 42 connected to the drive shaft 18, and arranged to balance the mass of the orbiting scroll arrangement 7. The first counterweight 41 is located above the first fixed scroll 4, and the second counterweight 42 is located below the second fixed scroll 5.

According to the embodiment shown on the figures, the first counterweight 41 and the drive shaft 18 are formed as a one-piece element, and the second counterweight 42 is distinct from the drive shaft 18 and is attached to the latter 18. For example, the first counterweight 41 may be formed by removing material from the drive shaft 18.

According to an embodiment of the invention, the first and second counterweights 41, 42 may be substantially equally spaced from the orbiting scroll arrangement 7.

The scroll compressor 1 also includes a refrigerant suction inlet (not shown in the figures) communicating with the inner chamber 6 to achieve the supply of refrigerant to the scroll compression unit 3, and a discharge outlet (not shown in the figures) for discharging the compressed refrigerant outside the scroll compressor 1.

Of course, the invention is not restricted to the embodiments described above by way of non-limiting examples, but on the contrary it encompasses all embodiments thereof.

What is claimed is:

1. A scroll compressor comprising:

a first fixed scroll comprising a first fixed spiral wrap, an orbiting scroll arrangement including at least a first orbiting spiral wrap, the first fixed spiral wrap and the first orbiting spiral wrap forming a plurality of first compression chambers, a drive shaft extending across the orbiting scroll arrangement, the drive shaft including a first portion and a second portion located on either side of the orbiting scroll arrangement, and a driving portion located between the first and second portions and adapted for driving the orbiting scroll arrangement in an orbital movement, a driving unit coupled to the drive shaft and arranged for driving in rotation the drive shaft about a rotation axis, and guide elements for guiding in rotation the drive shaft, the guide elements comprising at least a first guide bearing and a second guide bearing located on either side of the orbiting scroll arrangement and arranged to respectively guide the first and second portions of the drive shaft, wherein the drive shaft comprises a first end portion and a second end portion opposite to the first end portion, the first end portion including a central recess and having an external diameter larger than an external diameter of the second end portion.

2. The scroll compressor according to claim 1, wherein the first and second guide bearings are substantially equally spaced from the orbiting scroll arrangement.

3. The scroll compressor according to claim 1, further comprising a first counterweight and a second counterweight connected to the drive shaft, the first and second counterweights being located respectively on either side of the orbiting scroll arrangement.

4. The scroll compressor according to claim 3, wherein the first and second counterweights are substantially equally spaced from the orbiting scroll arrangement.

5. The scroll compressor according to claim 3, wherein the first counterweight and the drive shaft are formed as a one-piece element.

6. The scroll compressor according to claim 1, wherein the scroll compressor is a vertical scroll compressor and the drive shaft extends substantially vertically.

7. The scroll compressor according to claim 1, wherein the drive shaft is a stepped drive shaft.

8. The scroll compressor according to claim 7, wherein the stepped drive shaft includes at least four different diameters.

9. The scroll compressor according to claim 1, wherein the driving unit comprises a motor having a stator and a rotor, the drive shaft comprising a rotor support portion on which is fitted the rotor.

10. The scroll compressor according to claim 9, wherein the guide elements are located on a same side of the drive shaft relative to the rotor support portion.

11. The scroll compressor according to claim 9, wherein the first end portion of the drive shaft forms the rotor support portion.

12. The scroll compressor according to claim 1, wherein the drive shaft comprises at least one lubrication channel connected to an oil sump of the scroll compressor and extending over at least a part of the length of the drive shaft.

13. The scroll compressor according to claim 12, wherein the drive shaft further comprises at least a first lubrication hole and a second lubrication hole each fluidly connected to a respective lubrication channel, the first and second lubrication holes opening respectively into an outer wall of the first and second portions of the drive shaft.

14. The scroll compressor according to claim 12, wherein the drive shaft further comprises a third lubrication hole fluidly connected to a respective lubrication channel, the third lubrication hole opening into an outer wall of the driving portion of the drive shaft.

15. The scroll compressor according to claim 12, wherein the drive shaft further comprises at least one vent hole fluidly connected to a respective lubrication channel.

16. The scroll compressor according to claim 12, wherein the drive shaft comprises at least a first lubrication channel and a second lubrication channel, and further comprises a communicating channel arranged to fluidly connect the first and second lubrication channels.

17. The scroll compressor according to claim 2, further including a first counterweight and a second counterweight connected to the drive shaft, the first and second counterweights being located respectively on either side of the orbiting scroll arrangement.

18. The scroll compressor according to claim 4, wherein the first counterweight and the drive shaft are formed as a one-piece element.

19. The scroll compressor according to claim 2, wherein the scroll compressor is a vertical scroll compressor and the drive shaft extends substantially vertically.

20. A drive shaft for a scroll compressor, comprising:

a first portion and second portion adapted to be guided respectively by a first guide bearing and a second guide bearing of the scroll compressor, a driving portion adapted for driving an orbiting scroll arrangement of the scroll compressor in an orbital movement, the driving portion being located between the first and second portions of the drive shaft, wherein the drive shaft comprises a first end portion and a second end portion opposite to the first end portion, the first end portion including a central recess and having an external diameter larger than an external diameter of the second end portion.

* * * * *